US008951009B2

(12) United States Patent
Swiatek et al.

(10) Patent No.: US 8,951,009 B2
(45) Date of Patent: Feb. 10, 2015

(54) SCULPTED IMPELLER

(75) Inventors: Chester V. Swiatek, Amherst, NY (US); Mikhail Grigoriev, East Amherst, NY (US); James Hitt, Lancaster, NY (US)

(73) Assignee: Ingersoll Rand Company, Davidson, NC (US)

( * ) Notice: Subject to any disclaimer, the term of this patent is extended or adjusted under 35 U.S.C. 154(b) by 827 days.

(21) Appl. No.: 13/113,898

(22) Filed: May 23, 2011

(65) Prior Publication Data

US 2012/0301287 A1 Nov. 29, 2012

(51) Int. Cl.
*F01D 1/02* (2006.01)
*F01D 5/22* (2006.01)
*F04D 29/30* (2006.01)

(52) U.S. Cl.
CPC ..... *F04D 29/30* (2013.01)
USPC ..... 415/204; 416/185; 416/188; 416/234; 416/223 B

(58) Field of Classification Search
CPC ..... F04D 17/08; F04D 17/10; F04D 29/2216; F04D 29/24; F04D 29/242; F04D 29/28; F04D 29/284; F04D 29/30
USPC ..... 415/203, 204, 206; 416/175, 179, 180, 416/182, 185, 188, 234, 242, 243, 223 B
See application file for complete search history.

(56) References Cited

U.S. PATENT DOCUMENTS

| | | | | |
|---|---|---|---|---|
| 3,363,832 | A | 1/1968 | Groff | |
| 4,093,401 | A | 6/1978 | Gravelle | |
| 4,167,369 | A | 9/1979 | Ishihara | |
| 4,652,212 | A * | 3/1987 | Burger et al. | 416/188 |
| 4,653,976 | A | 3/1987 | Blair et al. | |
| 5,112,195 | A | 5/1992 | Cox | |
| 5,730,582 | A | 3/1998 | Heitmann | |
| 7,147,433 | B2 * | 12/2006 | Ghizawi | 415/164 |
| 7,563,074 | B2 | 7/2009 | Xu | |
| 7,628,586 | B2 | 12/2009 | Feher | |
| 2005/0260074 | A1 | 11/2005 | Higashimori | |
| 2007/0059179 | A1 | 3/2007 | Xu | |
| 2007/0267527 | A1 | 11/2007 | Graham et al. | |

FOREIGN PATENT DOCUMENTS

| | | |
|---|---|---|
| CN | 1386983 | 12/2002 |
| GB | 2127905 | 4/1984 |
| JP | 358119998 | 7/1983 |
| JP | 11022695 A * | 1/1999 |
| JP | 411022695 | 1/1999 |
| JP | 2002021574 | 1/2002 |
| JP | 2002332993 | 11/2002 |
| JP | 2004044473 | 2/2004 |
| WO | 2010103055 | 9/2010 |

OTHER PUBLICATIONS

PCT International Search Report for International Application No. PCT/US2012/027557, mailed Jul. 11, 2012.

* cited by examiner

*Primary Examiner* — Ned Landrum
*Assistant Examiner* — Alexander White

(57) ABSTRACT

A system, in certain embodiments, includes an impeller having a plurality of impeller blades coupled to an impeller hub body, wherein each impeller blade is sculpted having a non-linear profile extending from a hub intersect surface of the impeller blade to a shroud intersect surface of the impeller blade.

23 Claims, 5 Drawing Sheets

SCULPTED IMPELLER

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Centrifugal compressors or pumps may be employed to provide a pressurized flow of fluid for various applications. Such compressors or pumps typically include an impeller that is driven to rotate by an electric motor, an internal combustion engine, or another drive unit configured to provide a rotational output. As the impeller rotates, fluid entering in an axial direction is accelerated and expelled in a circumferential and a radial direction. The high-velocity fluid then enters a diffuser which converts the velocity head into a pressure head (i.e., decreases flow velocity and increases flow pressure). In this manner, the centrifugal compressor produces a high-pressure fluid output. Unfortunately, existing impeller geometry limits efficiency in centrifugal compressors and pumps.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
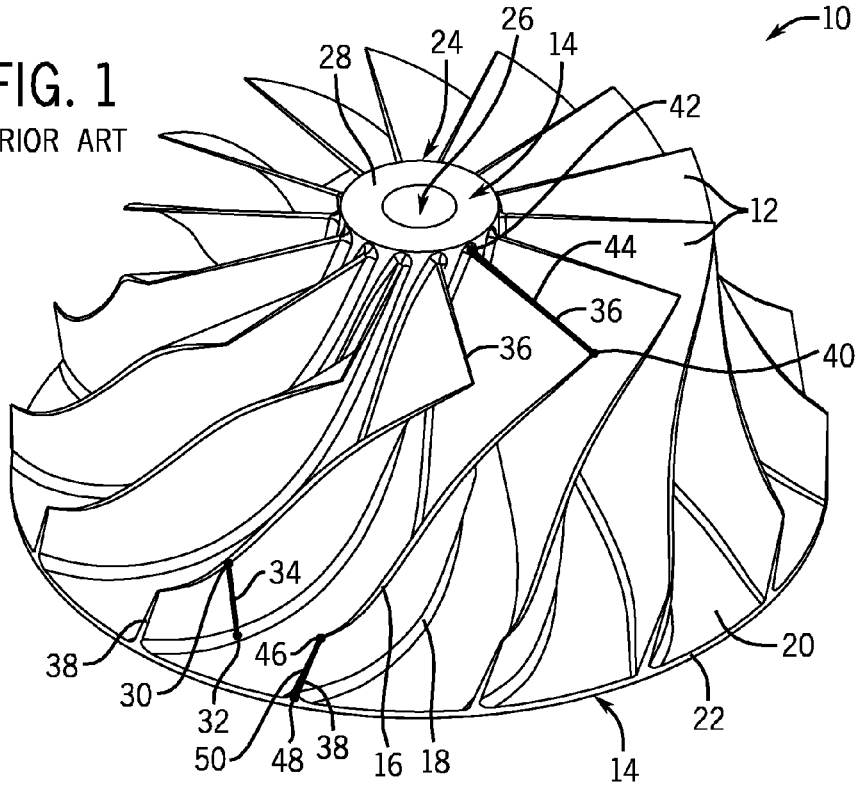
FIG. 1 PRIOR ART
FIG. 1 is a perspective view of an impeller having impeller blades, in accordance with existing impeller design.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Embodiments of the present disclosure may increase impeller efficiency by employing sculpted impeller blades. More specifically, each impeller blade includes a shroud intersect surface, a hub intersect surface, and a thickness extending between the shroud intersect surface and the hub intersect surface. For every point on the boundary of the shroud intersect surface, there is a corresponding point on the boundary of the hub intersect surface. The corresponding points on the shroud and intersect surfaces are connected to form the thickness and additional surfaces of the impeller blade. For example, the additional surfaces may include a pressure surface, a suction surface, a leading edge surface, or a trailing edge surface.

Embodiments of the present disclosure include impeller blades having a sculpted geometry. As described herein, the term "sculpted" refers to a surface of an impeller blade that is complex and three-dimensional. In other words, the sculpted surface may be formed by connecting two corresponding points on the shroud and hub intersect surfaces with a line that is not a straight line (i.e., the line connecting the two corresponding points is curved). As described below, the corresponding points on the shroud and hub intersect surfaces may be defined in a variety of ways. For example, for a given point along the hub intersect surface, the corresponding point along the shroud intersect surface may be the point along the shroud intersect surface that is a minimum distance from the given point along the hub intersect surface.

In the present embodiments, the curved lines extending between the shroud and hub intersect surfaces are generally orthogonal to a hub body of the impeller. For example, the pressure surface, the suction surface, the leading edge surface, and/or the trailing edge surface may be sculpted. Consequently, the thickness of the impeller blade extending between the shroud intersect surface and the hub intersect surface may vary or may be constant. In certain embodiments, a location of a maximum of the thickness between the hub intersect surface and the shroud intersect surface of each impeller blade varies from a leading edge to a trailing edge of each impeller blade. Furthermore, certain embodiments of the impeller blades may include pressure surfaces, suction surfaces, leading edge surfaces, and/or trailing edge surfaces with a sculpted portion and a non-sculpted portion. In this manner, the impeller blades may be cost-effectively designed for improved flow dynamics and impeller efficiency for any of a variety of applications and physical conditions.

Turning now to the drawings, FIG. 1 is a perspective view of an impeller 10 (e.g., an impeller of a centrifugal gas compressor) configured to output pressurized fluid flow, in accordance with existing impeller design (i.e., an impeller 10 having non-sculpted surfaces). The impeller 10 includes multiple impeller blades 12 coupled to a hub 14 (i.e., a hub body). As the impeller 10 is driven into rotation by an external source (e.g., electric motor, internal combustion engine, etc.), compressible fluid entering the blades 12 is accelerated toward a diffuser (not shown) disposed radially about the impeller 10. In certain embodiments, a shroud (not shown) is positioned directly adjacent to the diffuser, and serves to direct fluid flow from the impeller 10 to the diffuser. From the diffuser, the high-velocity fluid flow from the impeller 10 may be converted into a high pressure flow (i.e., convert the dynamic head to pressure head) and directed to a scroll (not shown) configured to direct the fluid flow from the diffuser out of the centrifugal gas compressor (not shown).

Figure 3:
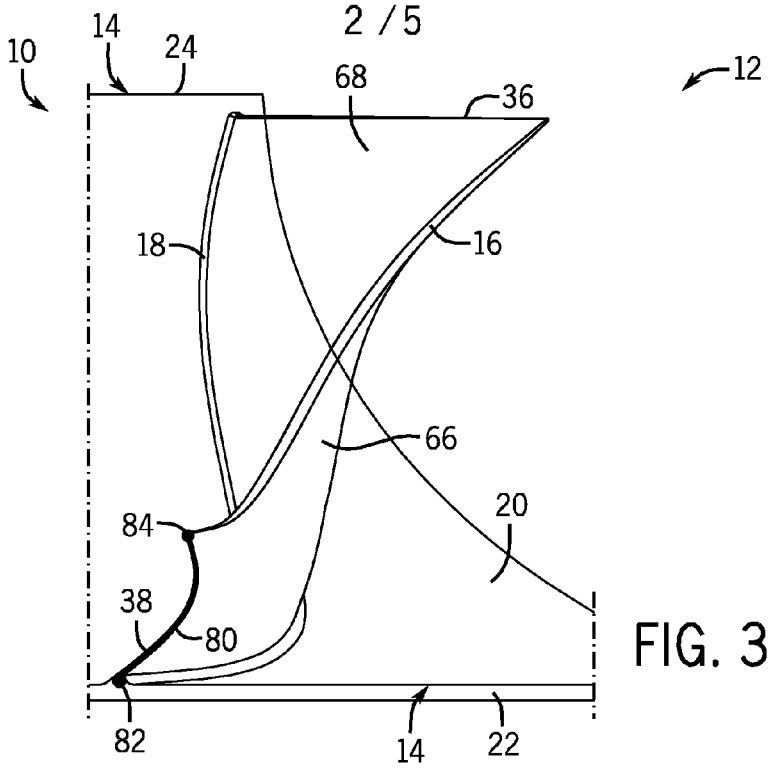
FIG. 3 is a side view of the impeller of FIG. 2, illustrating an impeller blade having sculpted surfaces between the shroud intersect surface and the hub intersect surface, in accordance with aspects of the present disclosure.

Each impeller blade 12 has a shroud intersect surface 16 and a hub intersect surface 18. In general, the shroud intersect surface 16 is disposed proximate to the shroud when the impeller 10 and the shroud are assembled together, and the hub intersect surface 18 is the location along the hub 14 of the impeller 10 at which the impeller blade 12 is attached to the hub 14. It will be appreciated that the hub 14 includes a generally curved surface 20 that extends from an outer circumference 22 of the impeller 10 to an annular inner core 24 having a hollow, cylindrical inner volume 26 surrounded by an annular wall 28. For example, a side view of the generally curved surface 20 that extends from the outer circumference 22 of the impeller 10 to the annular inner core 24 is illustrated in FIG. 3, which is described in greater detail below.

In the embodiment illustrated in FIG. 1, the impeller blades 12 are non-sculpted. In other words, corresponding points on the shroud intersect surface 16 and the hub intersect surface 18 are connected by generally straight lines (e.g., the lines are formed using linear interpolation) extending generally orthogonally from the curved surface 20 of the hub 14. For example, each point 30 on the shroud intersect surface 16 corresponds with a respective point 32 on the hub intersect surface 18, and the points 30 and 32 are connected by a generally straight line 34 projecting from the curved surface 20 in a generally orthogonal direction.

Additionally, each impeller blade 12 includes a leading edge surface 36 and a trailing edge surface 38. In the illustrated embodiment, the leading edge surface 36 and the trailing edge surface 38 are each defined by generally straight lines connecting corresponding points on the shroud intersect surface 16 and the hub intersect surface 18. For example, a point 40 on the shroud intersect surface 16 and a point 42 on the hub intersect surface 18 correspond with one another, and are connected by a generally straight line 44 along the leading edge surface 36. Due to the curved nature of the surface 20 of the hub 14, the straight line 44 generally extends radially outward along the leading edge surface 36 from point 42 to point 40. Similarly, a point 46 on the shroud intersect surface 16 and a point 48 on the hub intersect surface 18 correspond with one another, and are connected by a generally straight line 50 along the trailing edge surface 38. Due to the curved nature of the surface 20 of the hub 14, the straight line 50 generally extends axially upward along the trailing edge surface 38 from point 48 to point 46.

As will be appreciated, the illustrated impeller blades 12 having surfaces formed by straight lines between corresponding points on the shroud intersect and hub intersect surfaces 16 and 18 may be referred to as "ruled mean" model impeller blades 12, due to the linear interpolation involved in forming the generally straight lines between the corresponding points. In addition, it should be noted that corresponding points between the shroud intersect and hub intersect surfaces 16 and 18 may be points along straight lines that extend generally orthogonally from the hub intersect surface 18 to the shroud intersect surface 16, or may be points along straight lines that extend radially outward from the hub intersect surface 18 to the shroud intersect surface 16.

Figure 2:
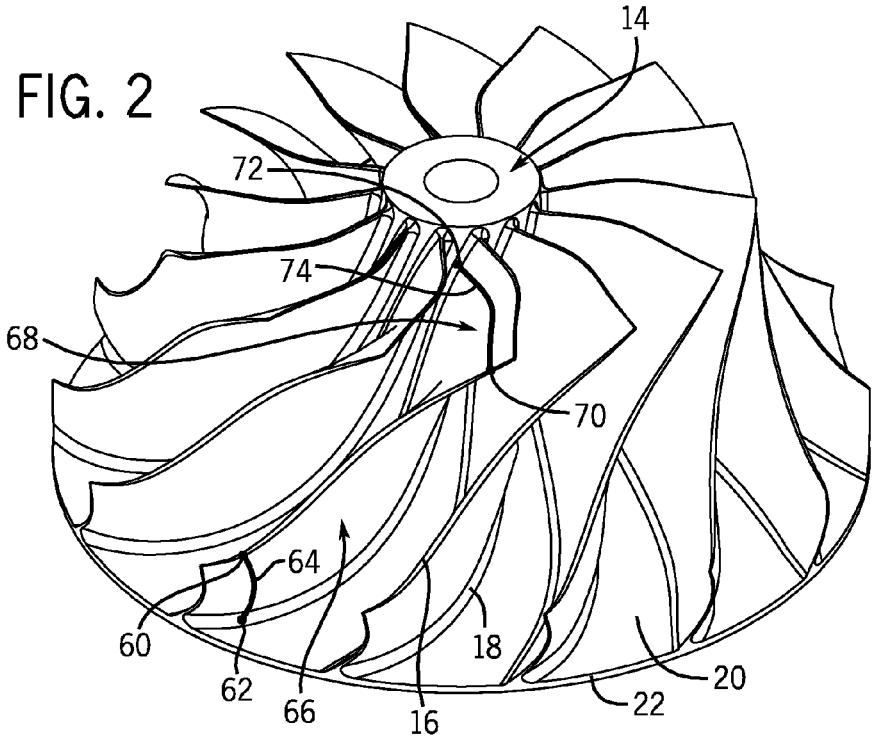
FIG. 2 is a perspective view of an impeller having impeller blades with sculpted surfaces between a shroud intersect surface and a hub intersect surface of each respective impeller blade, in accordance with aspects of the present disclosure.

In contrast to the non-sculpted impeller blades 12 illustrated in FIG. 1, FIG. 2 is a perspective view of an impeller 10 having impeller blades 12 that are sculpted, in accordance with aspects of the present disclosure. As mentioned above, "sculpted" impeller blades 12 refer to impeller blades 12 having at least one surface formed by non-straight lines between corresponding points on the shroud intersect and hub intersect surfaces 16 and 18. More particularly, the sculpted impeller blades 12 are configured to establish three-dimensional surfaces that may particularly match the fluid flow driven by the impeller 10. By contouring the three-dimensional surfaces of the impeller 10 to coincide with fluid flow within the impeller 10, efficiency of the impeller 10 may be increased compared to impellers with ruled mean surface impeller blades 12 (e.g., the impeller blades 12 shown in FIG. 1).

For example, a point 60 on the shroud intersect surface 16 and a point 62 on the hub intersect surface 18 correspond with one another and are connected by a curved line 64, which forms a portion of a pressure surface 66 of the impeller blade 12. As will be appreciated, curved lines 64 may be formed between all corresponding points on the shroud intersect and hub intersect surfaces 16 and 18 to form the sculpted pressure surface 66. In other embodiments, as described in detail below, curved lines 64 may be formed between some, but not all, of the corresponding points on the shroud intersect and hub intersect surfaces 16 and 18, thereby forming a sculpted portion of the pressure surface 66 and a ruled mean portion of the pressure surface 66. That is, some corresponding points on the shroud intersect and hub intersect surfaces 16 and 18 may be connected with curved lines 64, and some corresponding points may be connected with generally straight lines.

Similarly, a suction surface 68 of each impeller blade 12 may be sculpted. In other words, the suction surface 68 may be formed by curved lines connecting corresponding points on the shroud intersect and hub intersect surfaces 16 and 18. For example, a point 70 on the shroud intersect surface 16 and a point 72 on the hub intersect surface 18 may correspond with one another and be connected by a curved line 74, which forms a part of the suction surface 68. Further, curved lines 74 may be formed between all corresponding points on the shroud intersect and hub intersect surfaces 16 and 18 to form the sculpted suction surface 68. Alternatively, certain embodiments of the impeller blade 12 may include a sculpted portion of the suction surface 68 and a ruled mean portion of the suction surface 68. That is, some corresponding points on the shroud intersect and hub intersect surfaces 16 and 18 may be connected with curved lines 74, and some corresponding points may be connected with generally straight lines.

Furthermore, certain embodiments of the impeller 10 may have impeller blades 12 where the pressure surface 66 is a sculpted surface and the suction surface 68 is a ruled mean surface, or vice versa. For example, in one embodiment, the pressure surface 66 may be formed entirely by curved lines 64 extending between corresponding points on the shroud and hub intersect surfaces 16 and 18, and the suction surface 68 may be formed entirely by generally straight lines (i.e., lines formed by linear interpolation) extending between corresponding points on the shroud and hub intersect surfaces 16 and 18. In such an embodiment, the pressure surface 66 is a sculpted surface and the suction surface 68 is a ruled mean surface. Alternatively, in another embodiment, the pressure surface 66 may be formed entirely by generally straight lines (i.e., lines formed by linear interpolation) extending between corresponding points on the shroud and hub intersect surfaces 16 and 18, and the suction surface 68 may be formed entirely by curved lines 74 extending between corresponding points on the shroud and hub intersect surfaces 16 and 18. In such an embodiment, the pressure surface 66 is a ruled mean surface and the suction surface 68 is a sculpted surface.

The curved lines 64 and 74 which form all or a portion of the pressure surface 66 and suction surface 68, respectively, may be designed to correspond well with specific flow characteristics of fluid flow in the impeller 10, thereby increasing the efficiency and the flow momentum of the impeller 10. Additionally, impeller blades 12 which have sculpted surfaces may be formed by a milling or electrical discharge machining method.

FIGS. 3-7 illustrate various views of an impeller blade 12 of the impeller 10 of FIG. 2 having sculpted surfaces. FIG. 3 is a side view of the impeller blade 12 coupled to the hub 14 of the impeller 10. In the illustrated embodiment, the impeller blade 12 includes a sculpted pressure surface 66 and a sculpted suction surface 68. Additionally, the leading edge and trailing edge surfaces 36 and 38 are also sculpted. That is, corresponding points between the shroud intersect surface 16 and hub intersect surface 18 are connected by curved lines to at least partially define the pressure, suction, leading edge, and trailing edge surfaces 66, 68, 16, and 18. For example, the trailing edge surface 38 is at least partially formed by a curved line 80 extending between corresponding points 82 and 84 on the shroud intersect surface 16 and the hub intersect surface 18, respectively. As described above, the precise contour of the curved line 80 partially defining the trailing edge surface 38 may be computationally derived, and may be configured to increase the efficiency of the fluid flow through the impeller 10 and across the impeller blade 12. In certain embodiments, a length of the curved line 80 may be at least approximately 5, 10, 15, 20, 25, 30, 35, 40, 45, or 50 percent greater than a straight line between the points 82 and 84. For example, the length of the curved line 80 may be approximately 5 to 100, 10 to 50, or 15 to 25 percent greater than a straight line between the points 82 and 84. In certain embodiments, the curved line 80 may include one or more radii of curvature, which may be related to a straight line distance between the points 82 and 84, e.g., a radius of curvature that is approximately 0.1 to 100, 0.2 to 10, or 0.3 to 1 of the distance.

Figure 4:
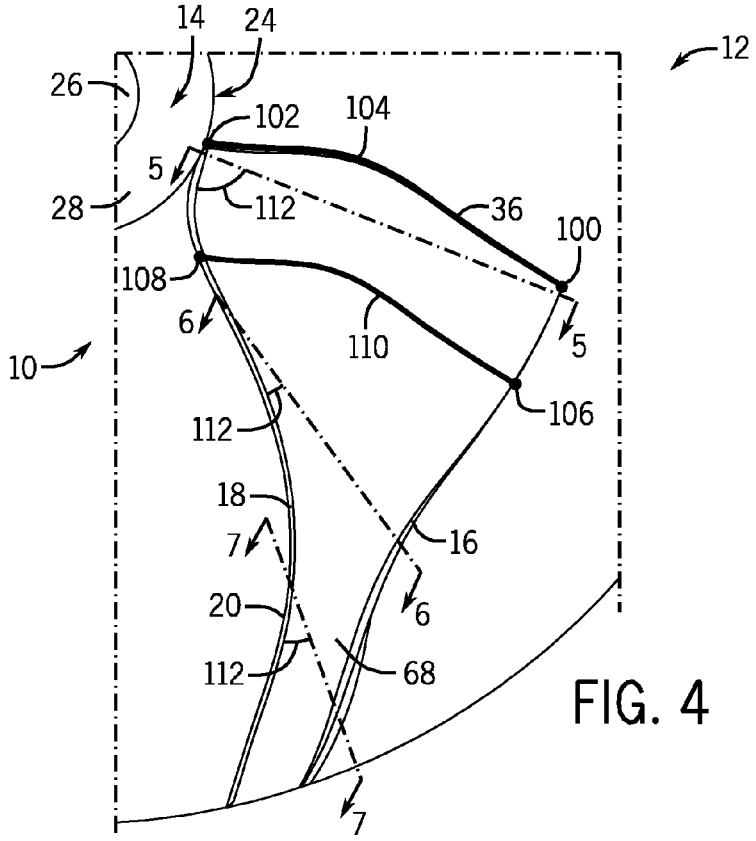
FIG. 4 is a top view of the impeller blade of FIG. 3, having sculpted surfaces between the shroud intersect surface and the hub intersect surface, in accordance with aspects of the present disclosure.

FIG. 4 is a top view of the impeller blade 12 shown in FIG. 3, illustrating the leading edge surface 36 and the suction surface 68, each of which are sculpted. More specifically, corresponding points 100 and 102 on the shroud intersect surface 16 and the hub intersect surface 18, respectively, are connected by a curved line 104, which partially defines the sculpted leading edge surface 36. The exact contour of the curved line 104 may be selected to improve the flow momentum of the fluid flow passing across the impeller blade 12. As mentioned above, the curved line 104 may be computationally derived for a specific impeller 10 application. As will be appreciated, the contour of the curved line 104 may vary depending on specific operating conditions of the impeller 10 and the fluid flow passing through impeller 10. For example, such operating conditions may include the viscosity of the fluid or the rotational speed of the impeller 10. Indeed, these considerations for computationally deriving the contour of the curved line 104 may be used for determining all of the sculpted surfaces described herein.

Furthermore, the suction surface 68 of the illustrated impeller blade 12 is sculpted. For example, corresponding points 106 and 108 on the shroud intersect surface 16 and the hub intersect surface 18, respectively, are connected by a curved line 110, which partially defines the sculpted suction surface 68. As with the curved line 104, the curved line 110 has a contour that is selected to increase the efficiency of the impeller 10. It should be noted that the contour of the curved line 110 may differ from the contours of other lines that partially define the suction surface 68. In other words, different portions of the suction surface 68 may have different slopes, angles, curves, etc. In this manner, the suction surface 68, and therefore the impeller blade 12, may have an infinite number of possible designs or configurations for increasing the efficiency of the impeller 10.

Figure 5:
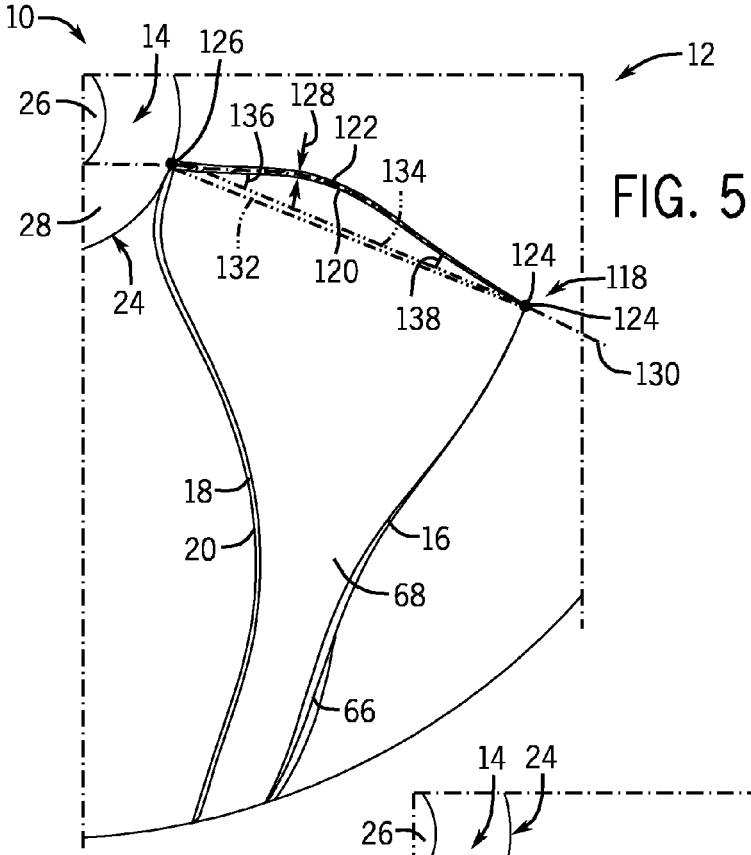
FIG. 5 is a top view of an impeller blade, taken along line 5-5 of FIG. 4, having sculpted surfaces between the shroud intersect surface and the hub intersect surface, in accordance with aspects of the present disclosure.
Figure 6:
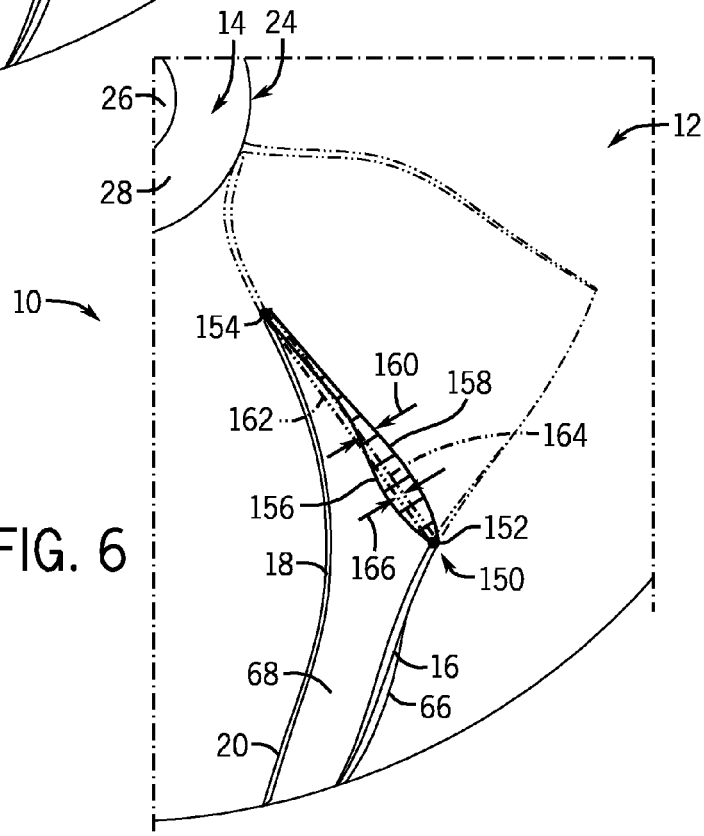
FIG. 6 is a top view of an impeller blade, taken along line 6-6 of FIG. 4, having sculpted surfaces between the shroud intersect surface and the hub intersect surface, in accordance with aspects of the present disclosure.
Figure 7:
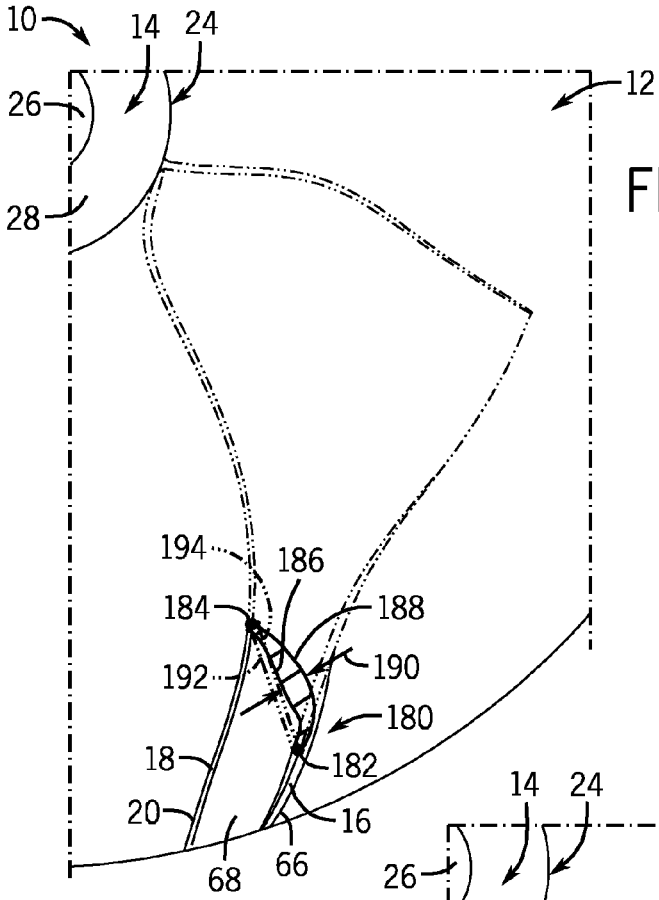
FIG. 7 is a top view of an impeller blade, taken along line 7-7 of FIG. 4, having sculpted surfaces between the shroud intersect surface and the hub intersect surface, in accordance with aspects of the present disclosure.

Furthermore, FIG. 4 includes various section lines for the cross sections shown in FIGS. 5-7. As shown, each section line is taken at an angle 112 relative to the hub intersect surface 18. More particularly, each angle 112 measures approximately 90 degrees. In other words, FIGS. 5-7 illustrate cross sections of the impeller blade 12 taken along a respective plane generally orthogonal to the hub intersect surface 18. Similarly, the planes through which the cross sections are taken are normal to the pressure and suction surfaces 66 and 68.

FIG. 5 is a top view, taken along line 5-5 of FIG. 4, of a top portion 118 the impeller blade 12, illustrating the difference between sculpted and ruled mean configurations of the pressure and suction surfaces 66 and 68. As illustrated, curved lines 120 and 122 are formed between a point 124 on the shroud intersect surface 16 and a point 126 on the hub intersect surface 18, where points 124 and 126 correspond with one another in a generally orthogonal direction projecting from the curved surface 20 of the hub 14 (e.g., the hub intersect surface 18). More specifically, the curved line 120 partially defines the top portion 118 of the suction surface 68, and the curved line 122 partially defines the top portion 118 of the pressure surface 66. A thickness 128 of the impeller blade 12 extends between the curved lines 120 and 122, and a curved camber line 130 extends between the points 124 and 126 approximately midway between the curved lines 120 and 122. As shown, the thickness 128 of the impeller blade 12 has a slightly decreasing taper from the point 126 (i.e., the hub intersect surface 18) to the point 124 (i.e., the shroud intersect surface 16). Moreover, the thickness 128 is relatively symmetrical across a mean camber line 130 of the impeller blade 12, at the cross-section shown in FIG. 5. In other words, the contours of the curved lines 120 and 122 are relatively similar from point 124 to point 126. In other embodiments, the contours of the curved lines 120 and 122 may be substantially different from one another from point 124 to point 126. Additionally, the thickness 128 of the impeller blade 12 may have other variations in other embodiments. For example, the thickness 128 may gradually or uniformly increase from the point 126 to the point 124. Furthermore, the amount that the thickness 128 increases or decreases between points 124 and 126 may vary. For example, the thickness may increase or decrease by 1 to 500, 2 to 250, 3 to 100, 4 to 50, or 5 to 25 percent. As discussed in detail below, the thickness 128 of the impeller blade 12 may also vary in a non-uniform manner.

The illustrated embodiment further illustrates reference lines 132 and 134. Specifically, the reference line 132 represents the line between corresponding points 124 and 126 for a ruled mean configuration of the top portion 118 of the suction surface 68. Similarly, the reference line 134 represents the line between corresponding points 124 and 126 for a ruled mean configuration of the top portion 118 of the pressure surface 66. As will be appreciated, the curved lines 120 and 122 have concave contours, whereas the reference lines 132 and 134 are generally straight. The concave contours of the curved lines 120 and 122, and as a result the sculpted surfaces of the suction and pressure surfaces 68 and 66, provide increased customization and efficiency of the impeller blade 12. Specifically, the exact contours of the curved lines 120 and 122 may be designed for improved flow dynamics and impeller efficiency for any of a variety of applications and physical conditions. In other embodiments, the curved lines 120 and 122 may have convex contours relative to the reference lines 132 and 134. Alternatively, the curved lines 120 and 122 may have contours including convex portions, concave portions, and other curves or forms.

In certain embodiments, lengths of the curved lines 120 and 122 may be at least approximately 5, 10, 15, 20, 25, 30, 35, 40, 45, or 50 percent greater than a straight line between the points 124 and 126. For example, the lengths of the curved lines 120 and 122 may be approximately 5 to 100, 10 to 50, or 15 to 25 percent greater than a straight line between the points 124 and 126. In certain embodiments, the curved lines 120 and 122 may include one or more radii of curvature, which may be related to a straight line distance between the points 124 and 126, e.g., a radius of curvature that is approximately 0.1 to 100, 0.2 to 10, or 0.3 to 1 of the distance. Moreover, in certain embodiments, the lengths of the curved lines 120 and 122 may be equal, and, in other embodiments, the lengths of the curved lines 120 and 122 may not be equal.

Furthermore, the curved lines 120 and 122 may be defined by angles between the curved lines 120 and 122 and the reference lines 132 and 134. For example, the curved line 120 may be partially defined by an angle 136 between the curved line 120 and the reference line 134 at any point along the curved line 120. Similarly, an angle 138 between the curved line 120 and the reference line 134 may be used to partially define the contour of the curved line 120. As will be appreciated, the angles 136 and 138 may be different at any given point along the curved line 120, and the angles 136 and 138 may vary along the curved line 120. Similar angles between the curved line 122 and the reference line 132 may be used to partially define the curved line 122.

FIG. 6 is a top view, taken along line 6-6 of FIG. 4, of a middle portion 150 of the impeller blade 12, illustrating the difference between sculpted and ruled mean configurations of the pressure and suction surfaces 66 and 68. In the illustrated embodiment, points 152 and 154 correspond with one another, and are connected by curved lines 156 and 158, in a generally orthogonal direction projecting outward from the curved surface 20 of the hub 14 (e.g., the hub intersect surface 18). The point 152 is located on the shroud intersect surface 16 and the point 154 is located on the hub intersect surface 18. More specifically, the corresponding points 152 and 154 may be defined by their respective locations along the shroud and hub intersect surfaces 16 and 18. For example, the point 152 may be defined as being 20 percent of the length of the shroud intersect surface 16 from the leading edge surface 36. As a result, the point 154, which corresponds with the point 152, would be defined as being 20 percent of the length of the hub intersect surface 18 from the leading edge surface 36. Additionally, the curved line 156 partially defines the middle portion 150 of the sculpted suction surface 68 of the impeller blade 12, and the curved line 158 partially defines the middle portion 150 of the sculpted pressure surface 66 of the impeller blade 12. Further, the middle portion 150 of the impeller blade 12 has a thickness 160 between the curved lines 156 and 158. As illustrated, the thickness 160 varies along the curved lines 156 and 158. In other words, the contours of the curved lines 156 and 158 are relatively different from point 152 to point 154. As mentioned above, the exact contours of the curved lines 156 and 158 may be computationally derived, and may be designed to improve the fluid flow across and the efficiency of the impeller blade 12.

Moreover, reference lines 162 and 164 are shown, illustrating the difference between a sculpted configuration and a ruled mean configuration of the impeller blade 12. More specifically, the reference line 162 represents the line between corresponding points 152 and 154 for a ruled mean configuration of the middle portion 150 of the suction surface 68. Similarly, the reference line 164 represents the line between corresponding points 152 and 154 for a ruled mean configuration of the middle portion 150 of the pressure surface 66. As mentioned above, the thickness 160 between the curved lines 156 and 158 varies between the corresponding points 152 and 154. Conversely, for the ruled mean configuration, a thickness 166 between the reference lines 162 and 164 is substantially constant. By varying the contours of the curved lines 156 and 158, thereby varying the thickness 160 of the middle portion 150 of the impeller blade 12, the impeller blade 12 may be designed for improved fluid flow across the impeller blade 12 for varying applications.

FIG. 7 is a top view, taken along line 7-7 of FIG. 4, of a lower portion 180 of the impeller blade 12, illustrating the difference between sculpted and ruled mean configurations of the pressure and suction surfaces 66 and 68. Corresponding points 182 and 184, located on the shroud intersect surface 16 and the hub intersect surface 18, respectively, are connected by curved lines 186 and 188 in a generally orthogonal direction projecting outward from the curved surface 20 of the hub (e.g., the hub interest surface 18). The corresponding points 182 and 184 may be defined by their respective locations along the shroud and hub intersect surfaces 16 and 18. For example, the point 182 may be defined as being 80 percent of the length of the shroud intersect surface 16 from the leading edge surface 36. As a result, the point 184, which corresponds with the point 182, would be defined as being 80 percent of the length of the hub intersect surface 18 from the leading edge surface 36. The curved line 186 partially defines the lower portion 180 of the sculpted suction surface 68, and the curved line 188 partially defines the lower portion 180 of the sculpted pressure surface 66. A thickness 190 of the lower portion 180 of the impeller blade 12 extends between the curves lines 186 and 188. The thickness 190 is non-constant across the curved lines 186 and 188, which as similarly discussed above, enables the impeller blade 12 to be designed for improved fluid flow and efficiency.

Moreover, reference lines 192 and 194 are included in FIG. 7 to illustrate a ruled mean configuration of the lower portion 180 of the impeller blade 12. In particular, the reference line 192 extends between corresponding points 182 and 184 and partially defines the suction surface 68 for a ruled mean configuration. Similarly, the reference line 194 extends between corresponding points 182 and 184 and partially defines the pressure surface 66 for a ruled mean configuration. As discussed above, the curved lines 186 and 188, unlike reference lines 192 and 194, may have varying contours specifically designed for improved flow and efficiency of the impeller blade 12.

Figure 8:
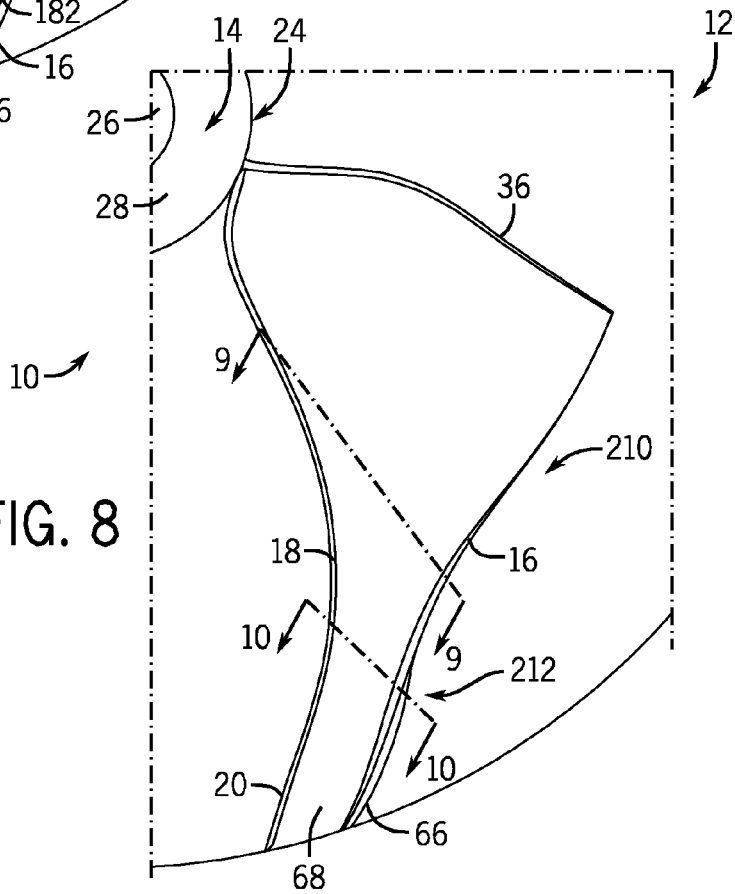
FIG. 8 is a top view of an impeller blade, having sculpted and non-sculpted surfaces between the shroud intersect surface and the hub intersect surface, in accordance with aspects of the present disclosure.
Figure 9:
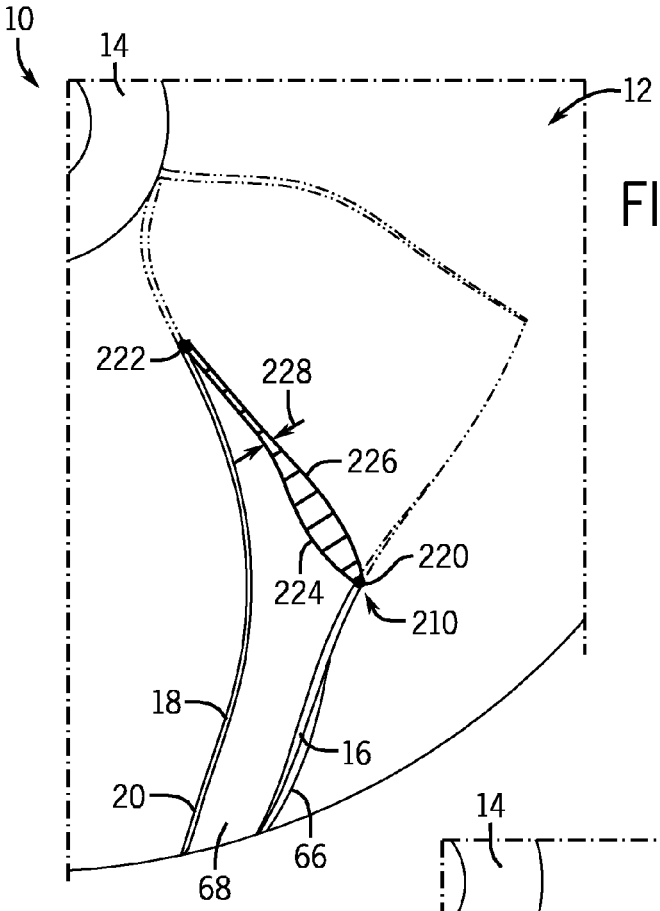
FIG. 9 is a top view of an impeller blade, taken along line 9-9 of FIG. 8, having sculpted and non-sculpted surfaces between the shroud intersect surface and the hub intersect surface, in accordance with aspects of the present disclosure.
Figure 10:
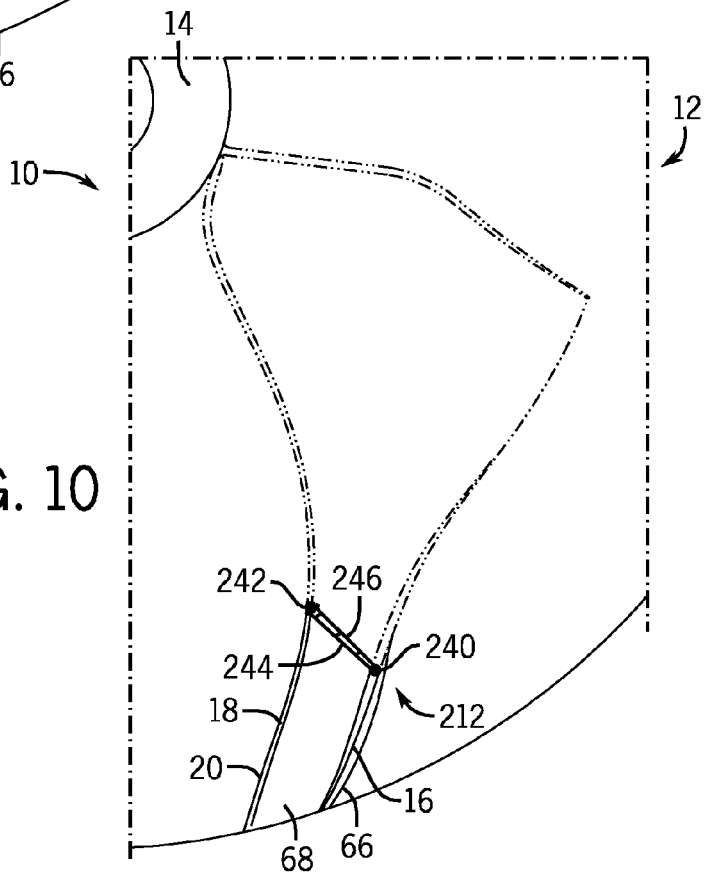
FIG. 10 is a top view of an impeller blade, taken along line 10-10 of FIG. 8, having sculpted and non-sculpted surfaces between the shroud intersect surface and the hub intersect surface, in accordance with aspects of the present disclosure.

FIGS. 8-10 illustrate various views of the impeller blade 12 of FIG. 2 having surfaces with a sculpted portion and a ruled mean portion. As described above, the impeller blade 12 may have a variety of configurations where surfaces or portions of surfaces are sculpted, and surfaces or portions of surfaces that are ruled mean. For example, a sculpted configuration for a certain portion or surface of the impeller blade 12 may provide greater increases in impeller 10 efficiency than a sculpted configuration for another portion or surface of the impeller blade 12. Consequently, a cost-benefit analysis may dictate using a sculpted configuration for certain portions or surfaces of the impeller blade 12, while using a ruled mean configuration for other portions or surfaces of the impeller blade 12. FIG. 8 is a top view of the impeller blade 12, illustrating the leading edge surface 36 and the suction surface 68. In the illustrated embodiment, the leading edge surface 36 has a sculpted configuration. Additionally, a first portion 210 of the impeller blade 12 has a sculpted configuration, and a second portion 212 of the impeller blade 12 has a ruled mean configuration.

FIG. 9 is a top view, taken along line 9-9 of FIG. 8, of the impeller blade 12, illustrating the sculpted configuration of the first portion 210 of the impeller blade 12. Corresponding points 220 and 222, located on the shroud intersect surface 16 and the hub intersect surface 18, respectively, are connected by curved lines 224 and 226 in a generally orthogonal direction projecting outward from the curved surface 20 of the hub 14 (e.g., the hub intersect surface 18). More specifically, the corresponding points 220 and 222 may be defined by their respective locations along the shroud and hub intersect surfaces 16 and 18. For example, the point 220 may be defined as being 20 percent of the length of the shroud intersect surface 16 from the leading edge surface 36. As a result, the point 222, which corresponds with the point 220, would be defined as being 20 percent of the length of the hub intersect surface 18 from the leading edge surface 36. The curved line 224 partially defines the suction surface 68 of the first portion 210, and the curved line 226 partially defines pressure surface 66 of the first portion 210. As mentioned above, the precise contours of the curved lines 224 and 226 may be selected for improved flow momentum and efficiency across the impeller blade 12. In particular, the curved lines 224 and 226 may have different contours than other lines extending between other corresponding points along the shroud and hub intersect surfaces 16 and 18. Furthermore, a thickness 228 of the first portion 210 extends between the curved lines 224 and 226. As shown, the thickness 228 varies between the corresponding points 220 and 222, which as similarly described above, enables the impeller blade 12 to be designed for improved fluid flow and efficiency.

FIG. 10 is a top view, taken along line 10-10 of FIG. 8, of the impeller blade 12, illustrating the ruled mean configuration of the second portion 212 of the impeller blade 12. Corresponding points 240 and 242, located on the shroud intersect surface 16 and the hub intersect surface 18, respectively, are connected by generally straight lines 244 and 246. More specifically, the corresponding points 240 and 242 may be defined by their respective locations along the shroud and hub intersect surfaces 16 and 18. For example, the point 240 may be defined as being 80 percent of the length of the shroud intersect surface 16 from the leading edge surface 36. As a result, the point 242, which corresponds with the point 240, would be defined as being 80 percent of the length of the hub intersect surface 18 from the leading edge surface 36. The generally straight line 244 partially defines the suction surface 68 of the second portion 212, and the generally straight line 246 partially defines the pressure surface 66 of the second portion 212. In certain embodiments, the second portion 212 of the impeller blade 12 may have a ruled mean configuration, as shown, because a sculpted configuration may not be considered cost effective for the second portion 212. In other words, having a sculpted configuration for the second portion 212 may not provide a great enough increase in the efficiency of the impeller 10 to justify the cost associated with sculpting the second portion 212.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An impeller, comprising:

a hub body; and a plurality of impeller blades extending from the hub body, wherein a first portion of each impeller blade of the plurality of impeller blades is sculpted having a nonlinear, curved profile extending from a hub intersect surface of the impeller blade to a shroud intersect surface of the impeller blade, wherein the nonlinear, curved profile has a radius of curvature that varies from a leading edge of the impeller blade to a trailing edge of the impeller blade, and wherein a location of a maximum of a thickness between the hub intersect surface and the shroud intersect surface of each impeller blade of the plurality of impeller blades varies from a leading edge to a trailing edge of each impeller blade of the plurality of impeller blades.

2. The impeller of claim 1, wherein the nonlinear, curved profile of each impeller blade of the plurality of impeller blades comprises a nonlinear pressure surface extending from the hub intersect surface to the shroud intersect surface.

3. The impeller of claim 2, wherein the nonlinear, curved profile of each impeller blade of the plurality of impeller blades comprises a linear suction surface extending from the hub intersect surface to the shroud intersect surface.

4. The impeller of claim 1, wherein the nonlinear, curved profile of each impeller blade of the plurality of impeller blades comprises a nonlinear suction surface extending from the hub intersect surface to the shroud intersect surface.

5. The impeller of claim 4, wherein the nonlinear, curved profile of each impeller blade of the plurality of impeller blades comprises a linear pressure surface extending from the hub intersect surface to the shroud intersect surface.

6. The impeller of claim 1, wherein the nonlinear, curved profile of each impeller blade of the plurality of impeller blades comprises a nonlinear leading edge surface extending from the hub intersect surface to the shroud intersect surface.

7. The impeller of claim 1, wherein the nonlinear, curved profile of each impeller blade of the plurality of impeller blades comprises a nonlinear trailing edge surface extending from the hub intersect surface to the shroud intersect surface.

8. The impeller of claim 1, wherein the nonlinear, curved profile of each impeller blade of the plurality of impeller blades comprises a non-constant thickness extending between the hub intersect surface and the shroud intersect surface.

9. The impeller of claim 1, wherein a second portion of each impeller blade of the plurality of impeller blades is non-sculpted having a linear profile extending from the hub intersect surface of the impeller blade to the shroud intersect surface of the impeller blade.

10. The impeller of claim 1, wherein the radius of curvature varies from the hub intersect surface to the shroud intersect surface.

11. An impeller, comprising:

a hub having a hub body; and a plurality of impeller blades extending from the hub body, each impeller blade of the plurality of impeller blades comprising:

a hub intersect surface proximate to the hub body;

a shroud intersect surface opposite the hub intersect surface;

a pressure surface extending between the hub intersect surface and the shroud intersect surface; and a suction surface extending between the hub intersect surface and the shroud intersect surface, wherein the suction surface and the pressure surface are separated by a thickness, wherein a first cross-section of the thickness normal to the pressure and suction surfaces comprises a nonlinear profile, wherein a location of a maximum of the thickness between the hub intersect surface and the shroud intersect surface of each impeller blade of the plurality of impeller blades varies from a leading edge to a trailing edge of each impeller blade of the plurality of impeller blades.

12. The impeller of claim 11, wherein a second cross-section of the thickness normal to the pressure and suction surfaces comprises a linear profile.

13. The impeller of claim 11, wherein a suction side boundary portion of the first cross-section of the thickness defined by the suction surface is nonlinear.

14. The impeller of claim 11, wherein a pressure side boundary portion of the first cross-section of the thickness defined by the pressure surface is nonlinear.

15. The impeller of claim 11, wherein the thickness is non-uniform from the hub intersect surface to the shroud intersect surface.

16. The impeller of claim 11, wherein the thickness is uniform from the hub intersect surface to the shroud intersect surface.

17. The impeller of claim 11, wherein a dimension of the maximum of the thickness between the hub intersect surface and the shroud intersect surface of each impeller blade of the plurality of impeller blades varies from the leading edge to the trailing edge of each impeller blade of the plurality of impeller blades.

18. A system, comprising:

a centrifugal gas compressor, comprising:

an impeller;

a diffuser configured to convert a high-velocity fluid flow from the impeller into a high-pressure fluid flow; and a scroll configured to direct the fluid flow from the diffuser out of the centrifugal gas compressor;

wherein the impeller comprises a plurality of impeller blades, wherein each impeller blade of the plurality of impeller blades comprises:

a sculpted portion having a nonlinear, curved profile extending from a hub intersect surface of the impeller blade to a shroud intersect surface of the respective impeller blade, wherein the nonlinear, curved profile has a radius of curvature that varies from a leading edge of the impeller blade to a trailing edge of the impeller blade; and a thickness separating a suction surface and a pressure surface of the respective impeller blade, wherein a location of a maximum of the thickness between the hub intersect surface and the shroud intersect surface of the respective impeller blade varies from a leading edge to a trailing edge of each impeller blade of the plurality of impeller blades.

19. The system of claim 18, wherein the nonlinear profile of each impeller blade of the plurality of impeller blades comprises a nonlinear pressure surface.

20. The system of claim 18, wherein the nonlinear profile of each impeller blade of the plurality of impeller blades comprises a nonlinear suction surface.

21. The system of claim 18, wherein each impeller blade of the plurality of impeller blades comprises a ruled mean portion having a linear profile extending from the hub intersect surface of the impeller blade to the shroud intersect surface of the respective impeller blade.

22. The system of claim 18, wherein the thickness of the impeller blade is non-uniform from the leading edge to the trailing edge.

23. The system of claim 18, wherein the radius of curvature varies from the hub intersect surface to the shroud intersect surface, and wherein a dimension of the maximum of the thickness between the hub intersect surface and the shroud intersect surface of each impeller blade of the plurality of impeller blades varies from the leading edge to the trailing edge of each impeller blade of the plurality of impeller blades.

* * * * *